US006205731B1

(12) United States Patent
Gerhaher

(10) Patent No.: US 6,205,731 B1
(45) **Date of Patent: *Mar. 27, 2001**

(54) FRONT PANEL POSITIONED IN FRONT OF A FACING CONSTRUCTION

(75) Inventor: Max Gerhaher, Landau (DE)

(73) Assignee: Franz Gerhaher, Straubing (DE); a part interest ( * ) Notice: Subject to any disclaimer, the term of this patent is extended or adjusted under 35 U.S.C. 154(b) by 0 days.

This patent is subject to a terminal disclaimer.

(21) Appl. No.: 09/150,534

(22) Filed: Sep. 9, 1998

(30) Foreign Application Priority Data

Sep. 10, 1997 (DE) ..... 197 39 749

(51) Int. Cl.[7] ..... E04F 13/00

(52) U.S. Cl. ..... 52/506.01; 52/506.05; 52/506.08; 52/235; 52/596; 52/302.3

(58) Field of Search ..... 52/506.1, 506.01, 52/506.05, 506.06, 506.08, 508, 235, 302.3, 783.1, 793.1, DIG. 138, 302.4, 597, 772, 596

(56) References Cited

U.S. PATENT DOCUMENTS

| | | | | |
|---|---|---|---|---|
| 324,716 | * | 8/1885 | Maurer | 52/506.08 |
| 853,702 | * | 5/1907 | Lally | 52/250 |
| 2,277,791 | * | 3/1942 | Small | 52/404.1 |
| 2,395,205 | * | 2/1946 | Watter | 52/506.06 |
| 3,686,805 | * | 8/1972 | Pofferi | 52/64 |
| 4,259,820 | * | 4/1981 | Kita et al. | 52/302.3 |
| 4,288,956 | | 9/1981 | Heck . | |
| 4,646,500 | * | 3/1987 | Smith | 52/506.03 |
| 5,028,469 | * | 7/1991 | Costard | 428/73 |
| 5,213,870 | | 5/1993 | Yamamato . | |
| 5,226,272 | * | 7/1993 | Sauve | 52/169.5 |
| 5,366,787 | * | 11/1994 | Yasui et al. | 428/174 |
| 5,390,462 | * | 2/1995 | Kreiter | 52/506.05 |
| 5,644,887 | * | 7/1997 | Gerhaher et al. | 52/606 |
| 5,809,720 | * | 9/1998 | Sauve | 52/302.4 |
| 5,850,722 | * | 12/1998 | Yasui | 52/793.11 |
| 5,860,257 | * | 1/1999 | Gerhaher et al. | 52/235 |

FOREIGN PATENT DOCUMENTS

| | | |
|---|---|---|
| 2401271 | 7/1974 | (DE) . |
| 2501323 | 7/1976 | (DE) . |
| 3401271 | 7/1985 | (DE) . |

* cited by examiner

*Primary Examiner*—Carl D. Friedman
*Assistant Examiner*—Jennifer I. Thissell
(74) *Attorney, Agent, or Firm*—Dilworth & Barese, LLP

(57) ABSTRACT

To at least considerably diminish or even completely prevent rain water from being driven inward in a strong wind, the front face (9) of the front slab segment (61) has horizontal grooves (68, 69, 70).

21 Claims, 5 Drawing Sheets

FRONT PANEL POSITIONED IN FRONT OF A FACING CONSTRUCTION

BACKGROUND OF THE INVENTION

The invention concerns a curtain-wall façade structure and a façade slab for a façade structure of this type. The invention also concerns a extrusion press tool for manufacturing a façade slab of this type.

A façade with façade slabs according to the main concept of claim 1 is known from DE-PS 34 01 271. These façade slabs consist of flat front and rear slab segments that are connected by stud links. Additionally, the back face of the slabs has a head and a foot lap that when the slab is mounted are positioned one beneath the other. Furthermore, the front lower edge of the façade slabs has a drainage lap that when the slab is mounted fits over the head lap of the slab below it in such manner that the front surfaces of the upper and lower façade slabs lie flat on one plane. The head lap of the lower façade slabs and the slab holders of the drainage lap or top façade slabs are covered in such manner that the holders are only partially visible. Between the foot lap of the upper façade slab and the head lap of the lower façade slab there is an open horizontal groove for ventilation of the façade. The façade slabs described are marketed in mill-finished, polished, and sandblasted surfaces.

Additionally, curtain-wall façade slabs are known that are less strong and are designed without perforations and without head, foot, and drain laps. These slabs are joined with open horizontal grooves of various widths. These façade slabs also are offered in mill-finished, polished, and sandblasted versions, and also in the form of decorative slabs with specific incised decoration.

In curtain-wall façades that are ventilated from behind, the grooves must be sufficiently open to permit a change of air to carry away the moisture diffused through the building wall. Through the pulsating effect of the wind, there is adequate ventilation through the open grooves of the façade slabs, which are overlapped like scales or abut one another on one plane. In rainy weather, particularly in the case of a driving rain, the water runs down the front of the façade slabs. Through the scale-like overlapping of façade slabs or the design of the overlapping head and drain laps the water drainage is improved in such manner that practically no driving rain can penetrate behind the façade slabs, yet ventilation and consequent exchange of moisture through the open horizontal grooves is not impeded.

The disadvantage of these known façade structures is that in the upper region of buildings, that is, near the roof edge, a strong wind can drive rainwater through the open horizontal grooves. The wind striking the building façade frontally collects on the façade and flows along both sides to the left and to the right and also upward near the top of the façade. In the case of tall buildings, particularly when the wind is strong, updriving wind velocities of such power can be reached in the upper reaches of the façade that the façade water stops flowing downward and is instead driven upward by the wind and, despite the overlapping of head and foot laps, is driven in large quantities through the open horizontal grooves behind the curtain-wall façade.

In the perforated slab according to DE-PS 24 01 271 there is a further disadvantage in that on the front surface, which during drying of plastic ceramic blanks is positioned at the top, in the area of the T-shaped cross-section formed by the front slab segment and the stud links, there is an accumulation of material that causes the formation, not only during drying, of shrinkage movements that take the form of optically unaesthetic flat depressions. In materials that are very sensitive to dryness the strong shrinkage movements can even lead to cracks.

DE-OS 25 01 323 discloses façade slabs for cladding building exteriors, which said slabs have recesses to give them the appearance of a brick or stone wall.

US-PS 52 13 870 discloses cladding slabs that have ornamental recesses.

US-PS 42 88 956 discloses cladding slabs made of rigid expanded polyurethane with recesses to hold attachment components.

Façade slabs having the cross-section shown in FIG. 5 have also become known. These façade slabs have a front slab segment 41 and a back slab segment 42 connected by link studs 43, 44, 45, forming core holes 46, 47 between them. The front face of the front slab segment 41 has horizontal grooves 48, 49, 50. The back face 51 of front slab segment 41 follows essentially the contour of the front face of front slab segment 41, so that this front slab segment has essentially the same wall thickness a throughout. Accordingly, near grooves 48, 49, 50 in front slab segment 41 there are joggles 52, 53, 54, 55, 56, 57, the result being that core holes 46, 47 are no longer rectangular compared to the original form without grooves 48, 49, 50; rather, they have indentations that correspond to joggles 52–57.

SUMMARY OF THE INVENTION

The task of the invention is to propose a façade slab of the type initially described that at least diminishes or even completely prevents the entry of rainwater when the wind is strong.

According to the invention, this task is accomplished by providing horizontal grooves on the front face of the front slab segment. Through the positioning of horizontal grooves the laminar layer of water flowing across the façade surface is broken and the flow resistance of the water is increased. The consequence thereof is that when the wind is strong less water is driven upward near the top of a façade, or the wind velocities at which the water begins to flow upward must be much higher than is the case with façades without grooves. Accordingly, less water is driven, or water is seldom driven, through the open horizontal grooves into the curtain-wall façade structure. Particularly in windy and rainy regions the moisture admission of the heat insulation and the building wall is considerably diminished. A further advantage is that the downward-flowing façade water flows slower and therefore after trickling down the window lintels strikes the windowsills with less speed, is less dispersed, and contributes less to the dirtying of the windowpanes.

A further advantage achieved by the invention is that quality defects in production are prevented, particularly if the façade slabs are manufactured by the extrusion press method.

Advantageous embodiments of the invention are described herein in the detailed description herein.

The disadvantage of the known façade slab shown in FIG. 5 is that the front slab segment 41 must be joggled, which is possible only through use of an appropriately designed extrusion press nozzle with appropriate cores, with corresponding recesses at their front corners. The disadvantages of such a nozzle are that the nozzle frame must be equipped with recesses that correspond to the grooves, and that therefore this nozzle cannot be used for the manufacturing of façade slabs without grooves. In addition, all cores on the corners that face the front wall must be equipped with appropriate recesses, which involves special processes that can be used only in nozzles for façades with grooves and even, strictly speaking, with grooves having a specific cross-section. Since nozzle cores must be extremely wear-resistant, and as a rule are made of hard steel or carbide metal or are cast as oxide ceramic, cores with special forms are correspondingly expensive. If normal cores, that is, corners without recesses at the corners, were used, the thickness of the front of the façade slab would be reduced to a portion of the necessary thickness. This is shown by the broken line in FIG. 5, bottom left. In contrast, if cores with corner recesses were used in normal nozzles (for slabs without grooves), the wall would become thicker in the junction area (front wall/stud link), and because of a surplus material accumulation cracks would therefore form during the drying that is necessary during the technological manufacturing process.

A further disadvantage of such a nozzle with joggled walls is that these joggles act as brakes that hinder the material flow of the plastic ceramic mass, so that the front wall of the façade slab exits the nozzle slower than the smooth back wall. This can lead to curvation and the formation of cracks or breakage of façade slabs during the drying process.

To prevent these disadvantages, an advantageous embodiment of the invention contributes to a thickness of the front slab section that is at least one and one-half times the depth of the grooves. The advantage of this is that the façade slabs have grooves on the front but no joggles are necessary on the front slab segment, so that a new nozzle corresponding exactly to the desired grooves is not necessary for the manufacturing of façade slabs with different groove shapes, sizes, and intervening spaces.

It is useful (but not a condition, and not absolutely necessary) if the stud link thickness around the chamfer radii of the core corners is such that they have at least more or less the same depth as the grooves.

The advantage of the preferred embodiment is that the wall between the groove floor and the core hole does not fall below the minimum necessary for reasons of manufacturing technology and strength. But if the grooves are eliminated from a slab cross-section that otherwise remains unchanged, the walls of the front slab segment and the stud links are thick enough that the elimination of the grooves does not lead to any excessive build-up of material and thus the danger of formation of cracks during the drying process and breakage during drying is kept within bearable limits. Since in the façade slab according to the invention it is not necessary to reinforce the walls around the core corners, normal rectangular cores with rounded corners can be used universally in all nozzles for façade slabs with or without grooves. This represents a considerable cost savings.

Another advantage of the façade slab according to the invention is that the groove depth, which is relatively limited in comparison to the wall thickness, allows the nozzle frame to have the same depth everywhere and eliminates the need for the strip-shaped recesses on the inside of the nozzle frame that are customarily necessary for the extrusion of grooves. Instead of such strip recesses, in the façade slab according to the invention the grooves can be designed in such manner that apertures having the desired shape and size of the grooves are positioned at the extrusion exit level of the nozzle, which said apertures fit into the continuous casting and shape the grooves. This is made possible without disadvantageous consequences by the fact that the pressure in the plastic ceramic materials inside the nozzle drops to zero at the time it exits the nozzle. The continuous casting thereupon expands crossways to its longitudinal axis in such manner that its individual wall cross-sections markedly enlarge, i.e. are plastically distorted. If at the same time the grooves are plastically embedded during this plastic distorting of the entire continuous casting, no major additional tensions are thereby created that could lead to an increase in the distortion or the breakage quotient during drying. Additionally, because the pressure at the nozzle outlet drops to zero the steady advance of the plastic ceramic material through (groove-shaped) apertures is much less disrupted there than is the case with (groove-shaped) strip recesses inside the nozzle, where the pressure is very high. The resulting advantage resides in the fact that for the manufacturing of grooved façade slabs of the type according to the invention the use of a single nozzle with smooth walls (without strip recesses) and with a single type of rectangular rounded-off cores is sufficient and the grooves can be manufactured in the various sizes and shapes and at the desired intervals merely by changing the aforementioned apertures.

A further advantage of the façade slab according to the invention is that at the nozzle outlet or immediately following it—viewed in the direction of the casting flow—thin steel wire loops designed in the desired shape of the grooves can be positioned to fit into, and cut the appropriate grooves in, the surface of the plastic continuous casting. All the above-described advantages of the façade slab according to the invention are further effectuated by reason of the fact that the use of a special nozzle with build-in strips for shaping the grooves and with special cores with recessed corners is unnecessary. Additionally, the wire-loop method is more cost-effective than the apertures method. However, there may possibly be less precision and adjustability to the desired groove shape with the wire-loop method.

It is also possible, however, to mill the desired grooves into the front face of the slab even after the drying or firing process. Here too all the above-described advantages of the façade slab according to the invention are effectuated by reason of the fact that the use of a special nozzle with build-in rips and special cores is unnecessary. The size and shape of the grooves can be varied by changing the shape, size, and engagement depth of the cutting mill.

A curtain-wall façade structure ventilated from behind, comprising a substructure, horizontal and/or vertical bearings profiles, and façade slabs having preferably a head lap on the top slab edge and a drainage lap on the bottom slab edge, with the façade slabs preferably able to be attached by means of slab holders or other devices to the bearing profiles is characterized by comprising a façade slab according to the invention.

The invention further concerns an extrusion press tool for manufacturing façade slabs according to the invention. According to the invention, the extrusion press tool has apertures that preferably are exchangeable and/or adjustable. According to an alternative solution the extrusion press tool has loops according to the invention.

BRIEF DESCRIPTION OF THE DRAWINGS

Embodiments of the invention are explained below in detail by means of the annexed drawing, which shows FIG. 1 A vertical section through a curtain-wall façade structure ventilated from behind, FIG. 2 A vertical section through a façade slab, FIG. 3 A vertical section through another façade slab, FIG. 4 A vertical section through another façade slab, FIG. 5 A vertical section through a previously known façade slab, FIG. 6 A vertical section through another façade slab, FIG. 7 The nozzle of an extrusion press tool with apertures, in a section view, FIG. 8 The nozzle shown in FIG. 7, in a frontal view, FIG. 9 The nozzle of an extrusion press tool with wire loops, in a section view, and FIG. 10 The nozzle shown in FIG. 9, in a frontal view.

DESCRIPTION OF THE PREFERRED EMBODIMENTS

Figure 1:
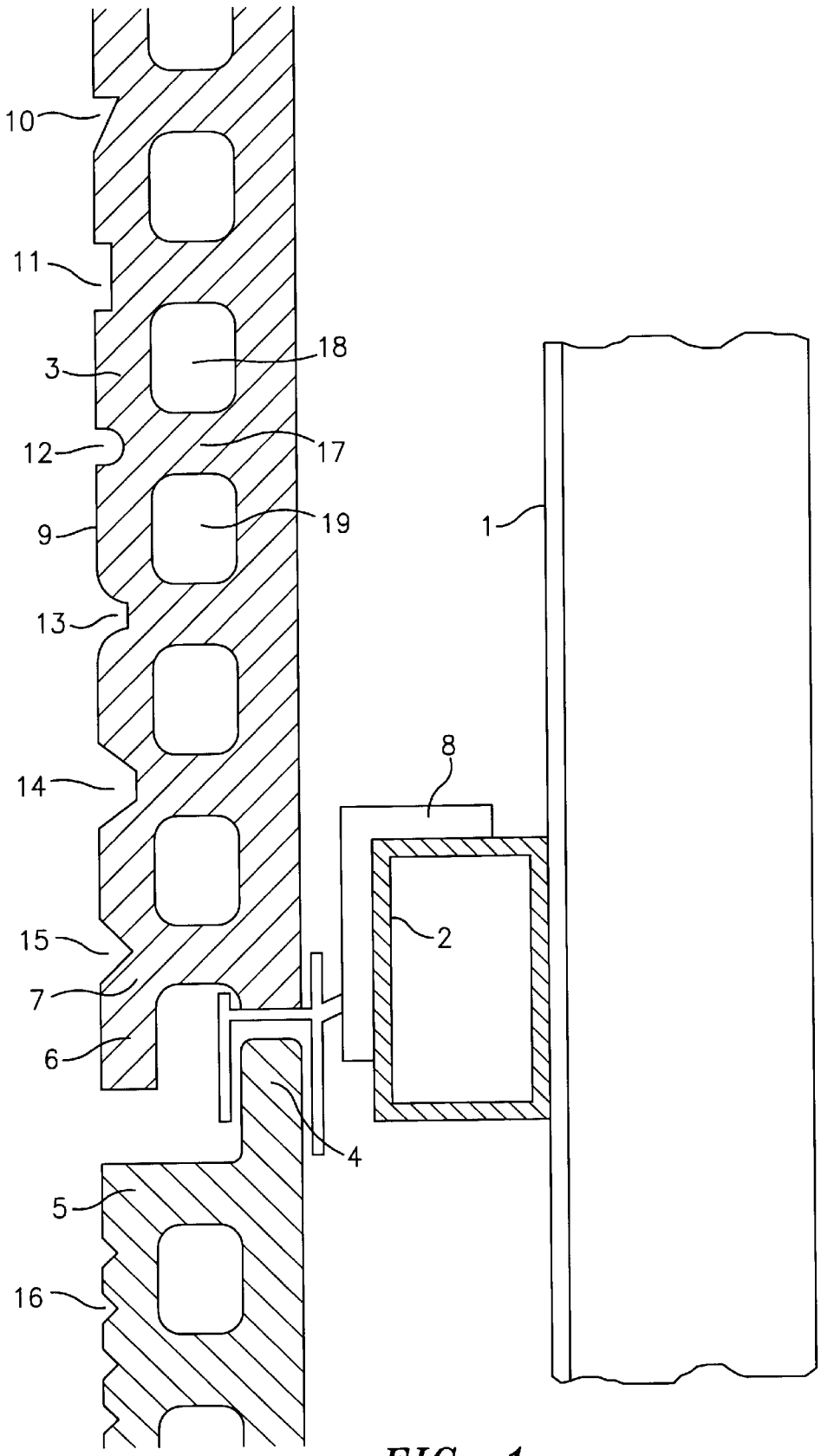

FIG. 1 shows a vertical under-structure 1 with horizontal bearing profiles 2 (vertical bearing profiles can also be used) and façade slabs 3, which are equipped with a head lap 4 at the top slab edge 5 and with a drainage lap 6 on bottom slab edge 7. The façade slabs 9 are attached to bearing profiles 2 by means of façade slab holders 8. The front face 3 of the front slab segment has horizontal grooves. Groove 10 has a wedge-shaped cross section, groove 11 has a rectangular cross section with rounded corners, groove 12 is a rounded slot, groove 13 is basket-shaped, groove 14 is trapezoidal, and grooves 15 and 16 are triangular. Every groove is positioned in front of the horizontal stud links 17 between core holes 18 and 19.

The façade slab shown in FIG. 1 is designed with various shapes of grooves by way of example. The façade slab consists of ceramic material. It is manufactured preferably by the extrusion press process. Each groove is positioned in the stud-links area between two holes in the front face of the façade slab. For façade slabs with horizontal holes, these grooves can be impressed into the slabs in one procedure in the extrusion press. Another advantage of horizontal grooves of this type is that the horizontal joint image of façade structures is overlaid by the shadow-casting grooves and is rendered unobtrusive. Through the arrangement of the grooves on the T-shaped cross-sections the material stresses during drying are lessened, so that the rejection quota because of cracks from drying or depression-shaped distortions can lessened. Even if the material stresses do not lead to breakage or rejection during drying or firing, in any case the compressive strength of the slabs is lessened, which increases the danger that they will come crashing down and endanger individuals. In massive façade slabs without holes or façade slabs with vertical holes, the grooves cannot be created in the pressing process, they must be added subsequently, e.g. by impression or by milling.

Figure 2:
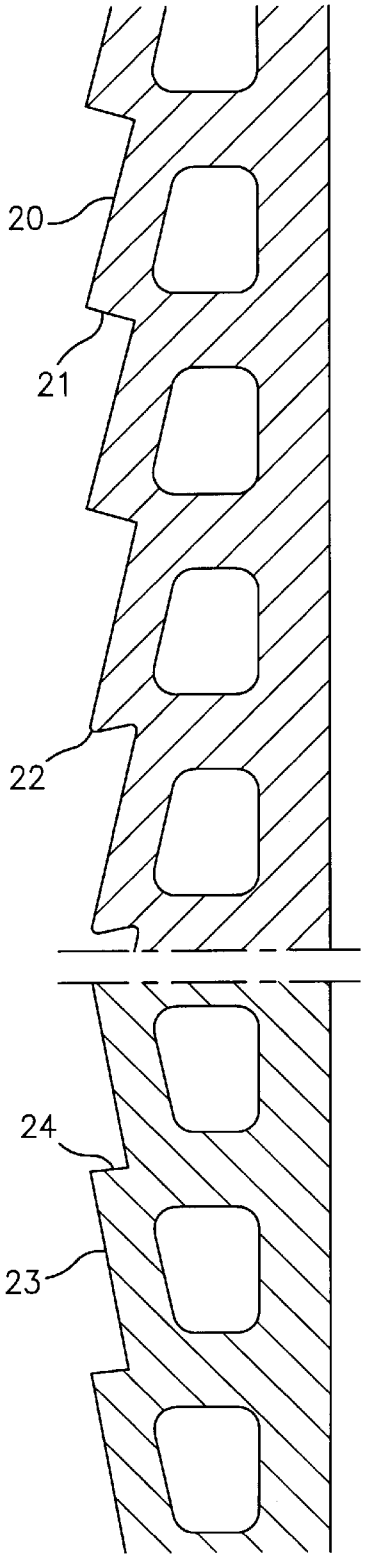

FIG. 2 shows another embodiment, in which faces 20 and 21 are positioned in sawtooth fashion and point downwards. The grooves are formed on the front of the façade slabs by two sawtooth-positioned surfaces. The advantage of this is that the resistance to water driven upward is considerably increased. Sawtooth point 22 is designed as a drainage edge. The two sawtooth-positioned areas are designed in such manner that a drainage edge is created. The advantage of this embodiment is that in light rain the façade slabs do not get so thoroughly wet, since the film of running water is interrupted.

In the lower portion of FIG. 2, the sawtooth areas 23 and 24 face upward; this creates reflection areas that by means of radar beams are deflected downward into the surrounding building area. The sawtooth areas point in the opposite direction from those in the upper portion of FIG. 2. The disadvantage is that resistance to upward-driven water is lessened. The advantage of this embodiment, however, is that radar reflections from aircraft flying in a landing-approach area are diverted downward into the ground or into the surrounding building area. Radar reflections from buildings are becoming increasingly significant as disruptive factors in civil aviation.

Another advantage of all grooved, particularly sawtooth-grooved, slabs is the diminution of acoustic reflection when curtain-wall façade slabs are hung inside meeting rooms or on soundproofing street walls.

Figure 3:
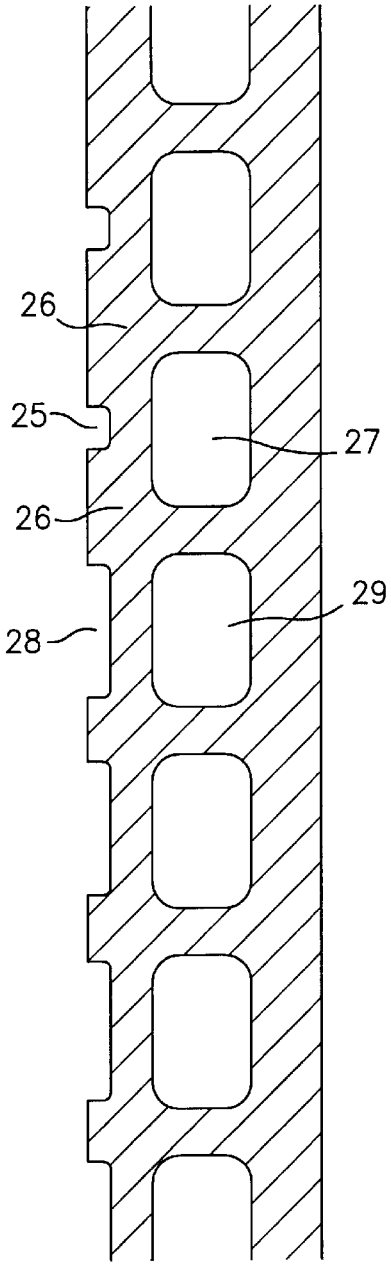

In the embodiment shown in FIG. 3, grooves of various widths are positioned not in front of the T-shaped cross-section 26, but between this T-shaped cross-section 26 and core hole 27. The grooves can be narrow 25 or wide 28, and they are positioned in front of core holes 27 or 29. In individual cases this can lead to manufacturing advantages with respect to ceramic material mixtures that are particularly difficult to dry. There are materials that are not sensitive to material accumulation at joints, but which can use a lessening of tension in the wall above the core hole in order to decrease the danger of breakage. In individual cases it can be determined (only) empirically if the material is sensitive to material accumulations at the joint or in the area between the joints. However, the essential advantage of wide grooves is that they provide increased resistance to flow and also form an additional water collector, whereby the danger that strong wind will drive water inward is further considerably diminished.

Figure 4:
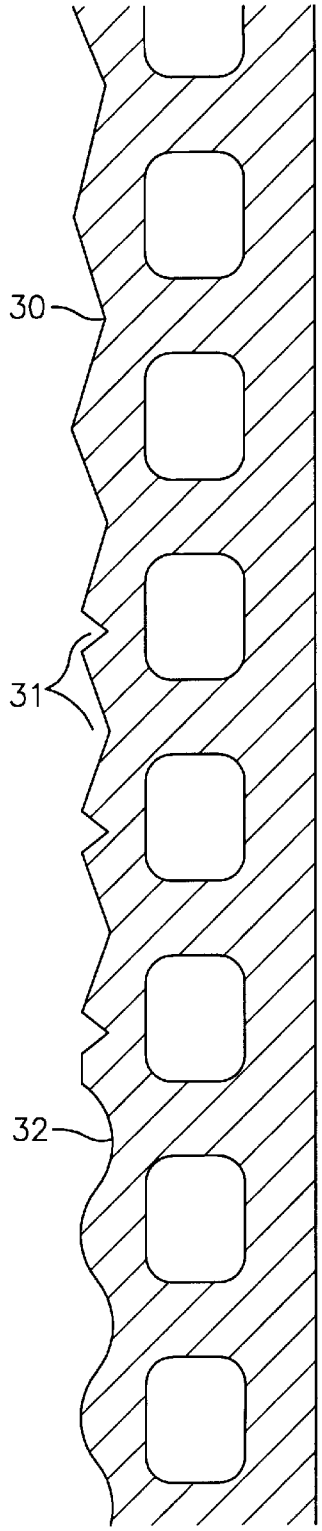

The embodiments shown in FIG. 4 as examples have in the upper area very shallow triangular grooves 30 and in the lower area an alternation of shallow and sharp triangular grooves 31. Wave-like grooves 32 are shown at the very bottom. In the upper portion the grooves are symmetrical and very shallow; in the center area, in contrast, they alternate between shallow and pointed. The advantage is in particular that the pointed channel can serve as a guide when façade slabs are being cut freehand. In the bottom portion of FIG. 4 there is another embodiment with long wavelike grooves. Particularly when ceramic materials that are especially sensitive to dryness are being worked on, the advantage resides particularly in the fact that no indentation effect occurs at any point on the top surface of the façade slab. The core holes are vault-shaped, to prevent accumulations of surplus material.

Figure 5:
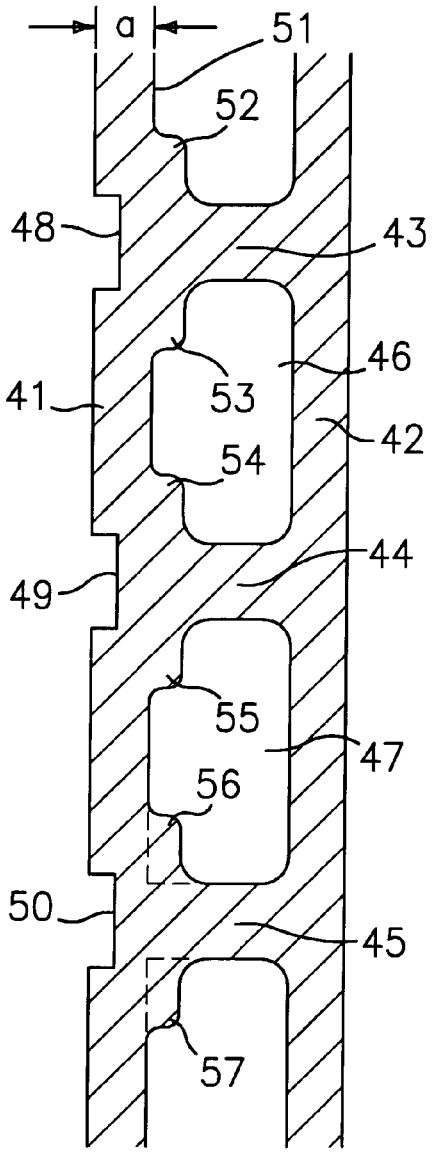
FIG. 5 (PRIOR ART)
Figure 6:
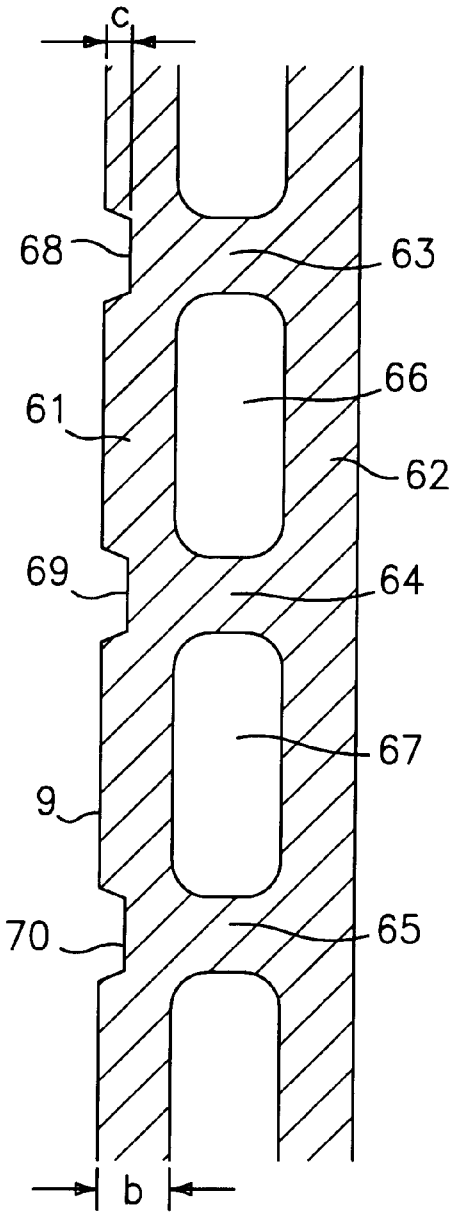

FIG. 6 shows a ceramic façade slab with a front slab segment 61 and a back slab segment 62, connected by stud links 63, 64, 65, with essentially rectangular core holes 66, 67 between stud links 63, 64, 65. Core holes 66,67 have rounded corners. In contrast to embodiments previously known from FIG. 5, core holes 66, 67 have no indentations formed by offsets.

In the embodiment according to FIG. 6, the front face 9 of front slab segment 61 has horizontal grooves 68, 69, 70, which are positioned in front of stud links 63, 64, 65, respectively, i.e. each groove is between two core holes. The wall thickness b of the front slab segment 61 is more than one and one-half times the depth c of grooves 68, 69, 70.

Figure 8:
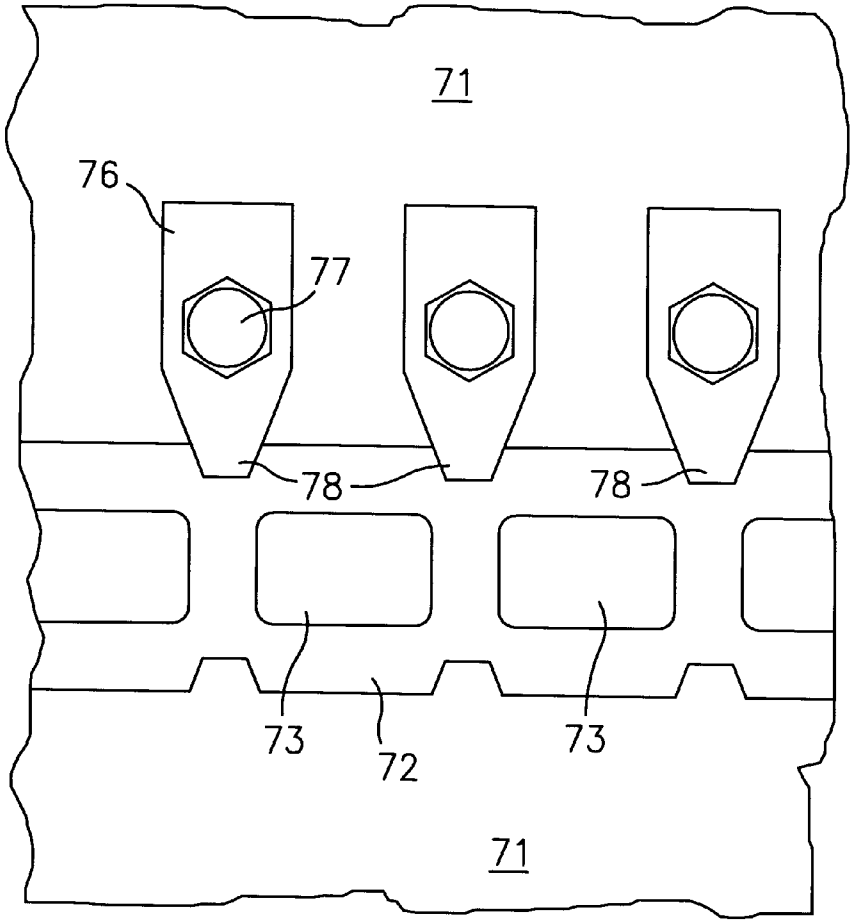
Figure 7:
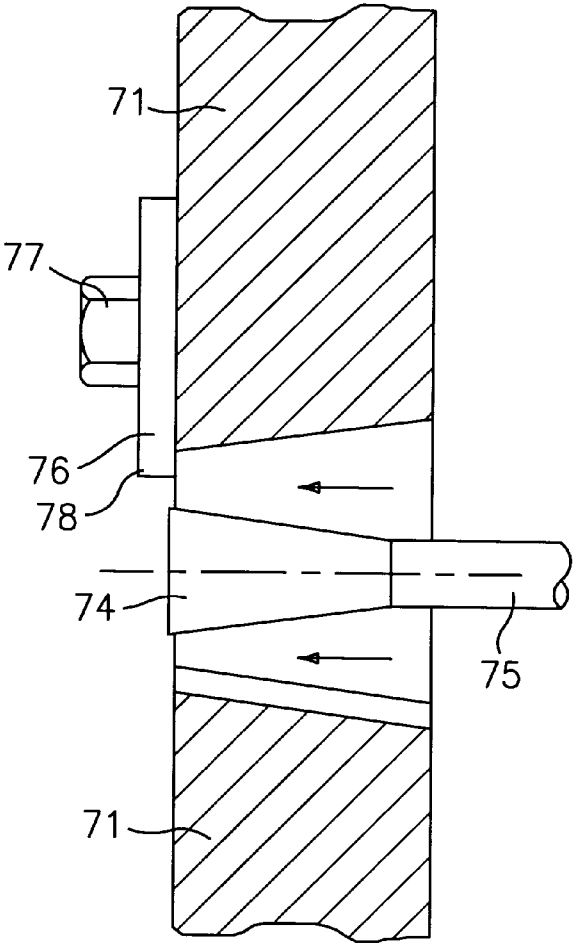

FIGS. 7 and 8 show a nozzle of an extrusion press tool. Nozzle-frame 71 has an opening that generally corresponds to the exterior contour of the façade slab 72 to be produced; this is shown in the bottom halves of FIGS. 7 and 8. The top halves of these figures shows an alternative in which the nozzle frame 71 has apertures 76. Core holes 73 of façade slab 72 are created by cores 74 each at the ends of a core rod 75. In the alternatives shown in the upper halves of FIGS. 7 and 8, apertures 76 are attached to the exterior of the nozzle frame 71 by means of screws 77, the ends 78 of which protrude into the opening of the nozzle frame 71. The ends 78 and apertures 76 are shaped in such manner that the desired groove contours are created in the outer surface of the façade slab 72. Because the apertures 76 are attached with screw 77 to nozzle frame 71, they can be changed. They can also be made adjustable, for example by having lengthwise holes.

Figure 10:
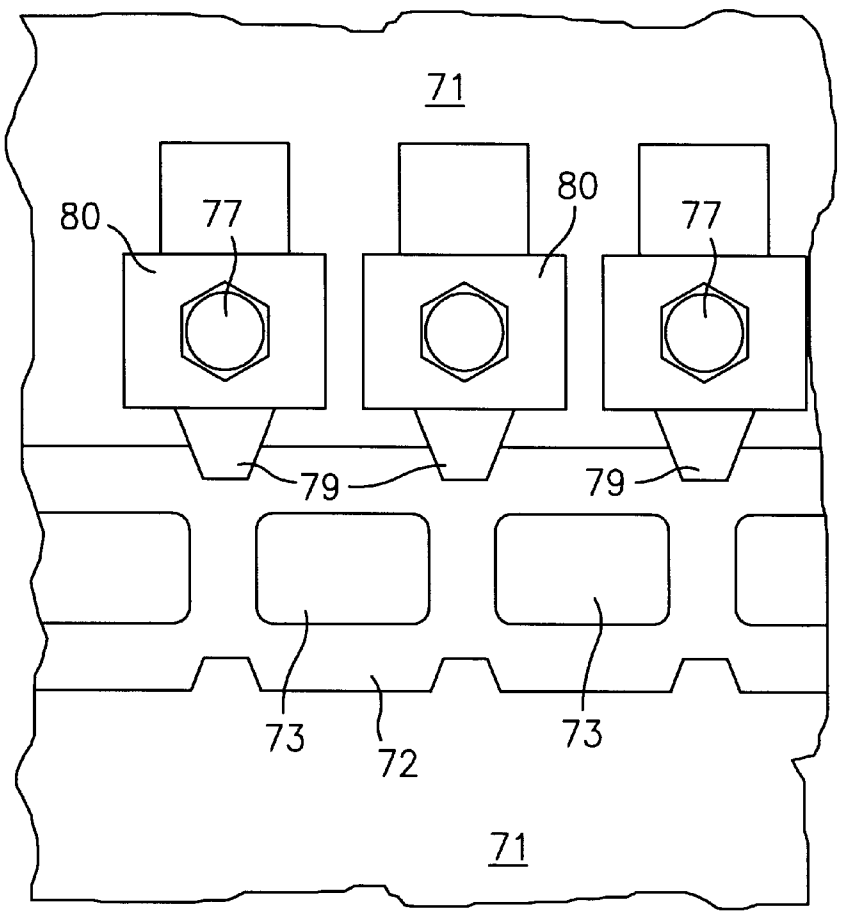
Figure 9:
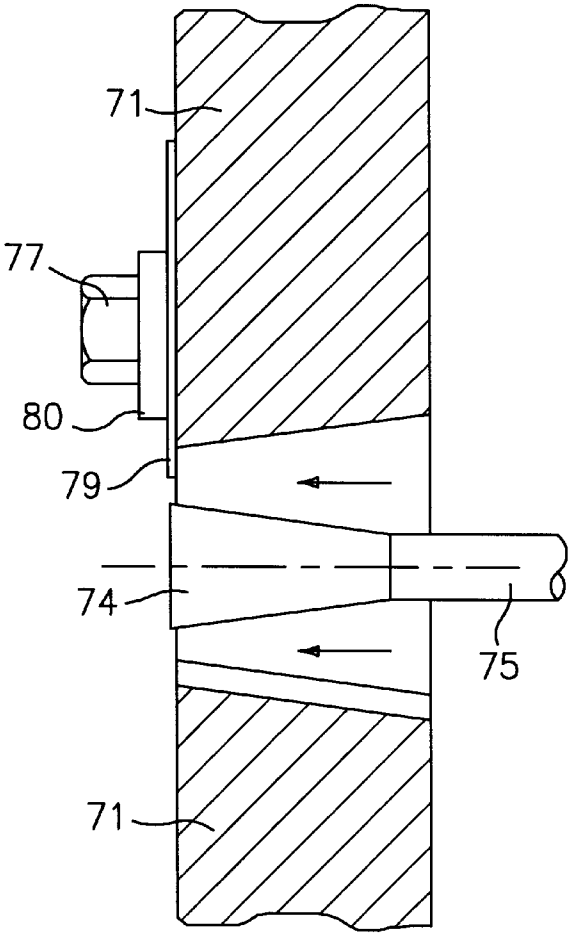

FIG. 9 and 10 show a modification of the nozzle illustrated in FIGS. 7 and 8 in which the pertinent parts have the same reference numbers. In the embodiment according to FIGS. 9 and instead of apertures 76 there are wire loops 79, attached by holders 80 to the nozzle framework 71. The wire loops 79 are clamped between the holders 80 and the nozzle frame 71, whereby holding power is created by screws 77. By means of screws the wire loops 79 can be changed and adjusted. Wire loops protrude into the opening of the nozzle frame 71. The contour of grooves created in the façade slab 72 corresponds to that of wire loops.

What is claimed is:

1. Façade slab made of ceramic with a front slab segment (61) and a back slab segment (62), which are linked by stud links (17; 63, 64, 65) and having core holes, (66,67) between the stud links(63, 64, 65) being essentially rectangular, wherein the slab is vertically disposed with a front face (9) of the front slab segment (61) having exposed horizontal grooves (10, 11, 12, 13, 14, 15, 16; 25, 28; 30, 31, 32, 68, 69, 70) with an absence of protuberances or joggles extending into the respective core holes (66, 67).

2. Façade slab according to claim 1, wherein the thickness of the front slab segment (61) wall (b) is at least one and one-half times the depth of the groove (c).

3. Façade slab according to claim 1, wherein the grooves (10, 11, 12, 13, 14, 15, 16; 30, 31, 32; 68, 69, 70) are positioned in front of the stud links (17; 63, 64, 65).

4. Façade slab according to claim 1, wherein the grooves (25, 28) are positioned in front of the core holes (27, 29).

5. Façade slab according to claim 1, wherein at least one of the horizontal grooves are wedge-shaped (10), rectangular with rounded corners (11), notch-shaped (12), basket-shaped (13), trapezoidal (14), triangular (15, 16), or have any combination of these shapes.

6. Façade slab according to claim 1, wherein the grooves are formed by a sawtoothed arrangement of individual oblique surfaces (20, 21) and point downwardly.

7. Façade slab according to claim 6, wherein the surfaces positioned in their sawtoothed arrangement have a drainage edge (22).

8. Façade slab according to claim 1, wherein the grooves are formed by a sawtoothed arrangement of individual opaque surfaces (23, 24) which point upwardly.

9. Façade slab according to claim 1, wherein the grooves (28) are almost as tall as, as tall as, or taller than, the core holes (29).

10. Façade slab according to claim 1, wherein the grooves (30) are shallow or alternatingly shallow and deep (31) or wave-shaped (32).

11. Curtain-wall façade structure ventilated from behind, comprising of a substructure (1), horizontal and/or vertical bearing profiles (2), vertically disposed façade slabs (3) having a head lap (4) on a top slab edge (5) and a drainage lap (6) on a bottom slab edge (7), with the façade slabs (3) structured and arranged to be attached by slab holders (8) or other devices to the bearing profiles (2), and comprising façade slabs according to claim 1.

12. Façade structure according to claim 11, wherein the grooves (10, 11, 12, 13, 14, 15, 16; 30, 31, 32; 68, 69,70) are positioned in front of the stud links (17; 63, 64, 65).

13. Façade structure according to claim 11, wherein the grooves (25, 28) are positioned in front of the core holes (27;29).

14. Façade structure according to claim 11, wherein the horizontal grooves are at least one of wedge-shaped (10), rectangular with rounded corners (11), notch-shaped (12), basket-shaped(13), trapezoidal(14), triangular (15,16), or have any combination of these shapes.

15. Façade structure according to claim 11, wherein the grooves are formed by a sawtoothed arrangement of individual oblique surfaces (20,21) and point downwardly.

16. Façade structure according to claim 15, wherein the surfaces positioned in the sawtoothed arrangement have a drainage edge (22).

17. Façade structure according to claim 11, wherein the grooves are formed by a sawtoothed arrangement of individual oblique surfaces (23, 24) which point upwardly.

18. Façade slab according to claim 1, wherein stud link thickness around chamfer radii of corners of the core holes have approximately the same depth as said grooves.

19. Façade structure according to claim 11, wherein stud link thickness around chamfer radii of corners of the core holes have approximately the same depth as said grooves.

20. The façade slab according to claim 1, wherein said front and back slab segments (61, 62) extend substantially parallel to one another.

21. The façade structure according to claim 11, wherein said front and back slab segments (61, 62) extend substantially parallel to one another.

* * * * *